US005261811A

United States Patent [19]

Bae

[11] Patent Number: 5,261,811

[45] Date of Patent: Nov. 16, 1993

[54] BURNER CONTROL SYSTEM AND METHOD

[75] Inventor: Young D. Bae, Suweon, Rep. of Korea

[73] Assignee: SamSung Electronics Co., Ltd., Kyungki, Rep. of Korea

[21] Appl. No.: 737,239

[22] Filed: Jul. 29, 1991

[30] Foreign Application Priority Data

Aug. 7, 1990 [KR] Rep. of Korea ..... 90-12083

[51] Int. Cl.[5] ..... F23N 1/00

[52] U.S. Cl. ..... 431/12; 236/15 BD

[58] Field of Search ..... 431/12, 36, 37, 41, 431/76, 75, 31; 236/15 BD; 417/326; 415/32

[56] References Cited

U.S. PATENT DOCUMENTS

| | | | |
|---|---|---|---|
| 3,610,782 | 10/1971 | McGuire, III | 417/326 |
| 4,585,161 | 4/1986 | Kusama et al. | 431/12 X |
| 4,749,122 | 6/1988 | Shriver et al. | 236/15 BD |
| 4,770,627 | 9/1988 | Yoshino | 236/15 BD |
| 4,994,959 | 2/1991 | Ovenden et al. | 236/15 BD |

*Primary Examiner*—Harry B. Tanner
*Attorney, Agent, or Firm*—Robert E. Bushnell

[57] ABSTRACT

A burner control system for controlling loads such as a blower motor and an electronic pump of a burner which comprises a drive voltage regulating circuit for varying the drive voltages corresponding to the loads to thereby vary the amount of heat being generated from the burner in the actuated condition. A microprocessor outputs a plurality of load control signals. A drive signal generating circuit for initiating in response to the plurality of load control signals received from the microprocessor generates a plurality of drive signals for driving the loads. A driving circuit powers the loads in accordance with the plurality of drive signals from the drive signal generating circuit. A method for controlling loads such as a blower motor and an electronic pump of a burner comprises the steps of selecting drive voltages corresponding to the loads, selecting data corresponding to the selected drive voltages to output a plurality of load control signals; and receiving the plurality of load control signals to power the loads. Therefore, the thermal efficiency of the burner can be increased by preventing incomplete combustion which results from the unbalanced output of the blower motor with the amount of fuel being supplied by the electronic pump.

32 Claims, 4 Drawing Sheets

FIG. 3(a)

| MODE \ $A/D_1$ (VOLT) | 0 | 0.5 | 1 | 1.5 | 2 | 2.5 | 3 | 3.5 | 4 | 4.5 |
|---|---|---|---|---|---|---|---|---|---|---|
| HIGH | 1904 | 1965 | 2026 | 2087 | 2148 | 2209 | 2270 | 2331 | 2392 | 2453 |

FIG. 3(b)

| MODE \ $A/D_2$ (VOLT) | 0 | 0.5 | 1 | 1.5 | 2 | 2.5 | 3 | 3.5 | 4 | 4.5 |
|---|---|---|---|---|---|---|---|---|---|---|
| LOW | 1033 | 1073 | 1113 | 1153 | 1193 | 1233 | 1273 | 1313 | 1353 | 1393 |

FIG. 3(c)

| MODE \ EP (VOLT) | 0 | 0.5 | 1 | 1.5 | 2 | 2.5 | 3 | 3.5 | 4 | 4.5 |
|---|---|---|---|---|---|---|---|---|---|---|
| LOW | 7.63 | 7.63 | 7.63 | 7.63 | 7.63 | 7.63 | 7.63 | 7.63 | 7.63 | 7.63 |
| MEDIUM | 13.66 | 13.98 | 14.31 | 14.64 | 14.96 | 15.29 | 15.62 | 15.94 | 16.27 | 16.60 |
| HIGH | 20.54 | 21.23 | 21.93 | 22.92 | 23.32 | 24.02 | 24.72 | 25.42 | 26.12 | 26.82 |

FIG. 3(d)

| $AD_1$(VOLT) / $A/D_2$ (VOLT) | 0 | 0.5 | 1 | 1.5 | 2 | 2.5 | 3 | 3.5 | 4 | 4.5 |
|---|---|---|---|---|---|---|---|---|---|---|
| 0 | 1440 | 1476 | 1512 | 1548 | 1584 | 1620 | 1656 | 1692 | 1728 | 1764 |
| 0.5 | 1458 | 1494 | 1530 | 1566 | 1602 | 1638 | 1674 | 1710 | 1746 | 1782 |
| 1 | 1476 | 1512 | 1548 | 1584 | 1620 | 1656 | 1692 | 1728 | 1764 | 1800 |
| 1.5 | 1494 | 1530 | 1566 | 1602 | 1638 | 1674 | 1710 | 1746 | 1782 | 1818 |
| 2 | 1512 | 1548 | 1584 | 1620 | 1656 | 1692 | 1728 | 1764 | 1800 | 1836 |
| 2.5 | 1530 | 1566 | 1620 | 1638 | 1674 | 1710 | 1746 | 1782 | 1818 | 1854 |
| 3 | 1548 | 1586 | 1620 | 1656 | 1692 | 1728 | 1764 | 1800 | 1836 | 1872 |
| 3.5 | 1566 | 1622 | 1638 | 1674 | 1710 | 1746 | 1782 | 1818 | 1854 | 1890 |
| 4 | 1584 | 1620 | 1656 | 1692 | 1728 | 1764 | 1800 | 1836 | 1872 | 1908 |
| 4.5 | 1602 | 1638 | 1764 | 1710 | 1746 | 1782 | 1818 | 1854 | 1890 | 1926 |

BURNER CONTROL SYSTEM AND METHOD

BACKGROUND OF THE INVENTION

1. Field of the Invention

The present invention relates in general to a burner control system, and more particularly to a system and a method for controlling a blower motor and an electronic pump of a burner.

2. Background of the Invention

The conventional oil burner is provided with a blower motor adapted to draw air and supply it to a burner and with an electronic pump adapted to draw oil from an oil tank and supply it to the burner. Both the blower motor and the electronic pump should supply the optimum amount of air and oil to the burner in accordance with the combustion conditions of the burner in order to stabilize combustion and to minimize the occurrence of an oil odor developing thereby maximizing the combustion efficiency of the burner.

An apparatus for controlling such a burner is disclosed in U.S. Pat. No. 4,243,372. This patent utilizes a burner control apparatus for use with a fuel burner installation that has an operating control to produce a request for burner operation, a flame sensor to produce a signal when a flame is present in the monitored combustion chamber, and one or more devices for the control of ignition and/or fuel flow. The burner control apparatus comprises a lockout apparatus for de-energizing the burner control apparatus, a control device for actuating the ignition and/or fuel control devices, and a timing circuit that provides four successive and partially overlapping timing intervals of precise relation, including a purge timing interval, a pilot ignition interval, a pilot stabilization interval and a main fuel ignition interval. A burner control system is also disclosed which verifies proper operation of certain sensors in the burner or furnace, including particularly, an air flow sensor which prevents an attempt to ignite the burner if a condition is detected which indicates that the air flow sensor has been bypassed or wedged in the actuated position.

The burner control apparatus of U.S. Pat. No. 4,243,372 includes a first and a second timing circuits, a lockout relay, and a flame sensor failure detecting circuit, for the purpose of detection of malfunction of sensors, i.e., flame sensor failure, air flow sensor failure during purge, pilot flame sensor failure and loss of air flow during combustion, thereby enabling operations of a blower, a burner motor, a main fuel supply and a pilot fuel supply to be controlled.

Also taught in U.S. Pat. No. 4,243,372 is a safety device for protecting the user from fatal injuries which could result from the burner and peripheral devices. However, there is no teaching regarding any method of individually controlling the blower motor and the electronic pump based on quantity of heat generated from the burner. In other words, U.S. Pat. No. 4,243,372 does not teach developing the optimum/maximum quantity of heat from the burner by means of the blower motor and the electronic pump.

Japanese Laid-open Patent No. Sho 59-142330 teaches an improvement in improper combustion in a burner by varying the rotation of the blower motor with reference to a variation in voltage. A burner control apparatus is disclosed for use with a forced combustion burner installation that provides a reasonable quantity of air in connection with the quantity of gas supplied. The apparatus comprising an integrating circuit for detecting a positive half-wave peak value of a source voltage being applied to a combustion air supply motor, a switching device for discharging the integrating circuit by negative half-wave, an analog/digital converter for converting the peak value of the source voltage into a digital value, a timing synchronizer for transferring the digital value from the analog/digital converter to a microcomputer containing an arithmetic section therein, and a phase controller for receiving output from the arithmetic section, the arithmetic section having a correction operating function.

Japanese Laid-open Utility Model No. Sho 52-2335, discloses a burner control apparatus which sequentially controls the supply of fuel to the burner in multi-steps in accordance with the detected quantity of heat. The burner control apparatus comprises a return nozzle for receiving fuel oil from a fuel supply source at a constant pressure. The return nozzle includes a return section for returning part of the supplied fuel oil to the fuel supply source, an electronic valve disposed at the return section of the return nozzle, a temperature-sensitive device for sensing the temperature of a load, and a multi-single thermostat consisting of a plurality of electronic thermostat circuits with each circuit actuated in sequence in response to the operation of the temperature sensitive device. Thus, the combustion of the burner is controlled sequentially in multi-steps in accordance with the operation of the thermostat. The above techniques are designed for the purpose of increasing the combustion efficiency of the burner.

FIG. 1 illustrates a circuit diagram of a typical burner control apparatus which controls the blower motor and the electronic pump of the burner in accordance with the prior art. As illustrated, the burner control arrangement includes terminals A and B adapted to be connected to a suitable source of power. In a high combustion mode (high heat output), the contact "C" of the relay 3 for the blower motor 1 is switched to a high position "a" and the contact "C" of the relay 4 for the electronic pump 2 is switched to a drive position "a", while the contact "C" of the relay 5 is switched to an open position "b", so that voltage across the terminals A and B is applied via the high terminal "a" of the relay 3 to a condenser 10 and a resistor 11 and also to the blower motor 1 and via the drive terminal "a" of the relay 4 to the electronic pump 2. As a result, the blower motor 1 and the electronic pump 2 are driven in a high output condition, resulting in the high burner combustion, i.e. high heat output.

In the medium-output (medium range heat output) combustion mode, the contact C of relay 3 in the blower motor 1 is switched to a low position "b"; the contact "C" of relay 4 for the electronic pump 2 is switched to the drive position "a", contact "C" of a relay 6 is switched to a contact position "b" bypassing variable resistor 14, and the contact "C" of relay 5 is switched to a closed position "a". As a result, the voltage across the terminals A and B is applied via the low terminal "b" of the relay 3 to a condenser 12 and a resistor 13 and also to the blower motor 1 and via the drive terminal "a" of relay 4 and the closed terminal "a" of relay 5 to the electronic pump 2, so that the output of the blower motor 1 and the electronic pump 2 is at a midlevel condition.

In the low output (low heat output) combustion mode, the contacts "C" of relays 3 through 5 are switched to the same contact positions as those in the mid-output combustion mode, except that the contact "C" of relay 6 is switched to a contact position "a" via the variable resistor 14. Thus, the voltage varied by the variable resistor 14 is applied to the electronic pump 2, resulting in the electronic pump 2 being driven in a low output condition.

As described above, the conventional burner control arrangement performs the selection of heat output only at three stages, i.e., high, medium and low, so as to determine quantity of oil supplied to the burner.

Also, as mentioned above, the contacts of relay 3, which are connected to taps disposed at coils of the blower motor, are selected to determine the output of the blower motor 1.

Therefore, the number of rotations of the blower motor 1, i.e. output of the blower motor, is selected in accordance with the voltage induced from the taps of the motor 1, and the frequency of an electronic pump control circuit is varied by changing the contact of the relays connected to the electronic pump 2, so that the quantity of oil being supplied to the burner can be varied.

As described above, the speed of the blower motor and the quantity of oil delivered by the electronic pump are selected to yield a high, a medium or low output, in accordance with the selection of heat desired to be generated. Thus, the number of rotations of the blower motor and the quantity of discharge from the electronic pump are fixed notwithstanding the combustion conditions of the burner.

However, the conventional burner control arrangement as described above has the disadvantage, in that the operations of the blower motor and electronic pump in the initial combustion state are not in agreement with the actual combustion conditions of the burner. This results in unstable combustion which in turn results in an intense oil odor and decreased combustion efficiency of the burner.

Also, the conventional burner control arrangement has additional defects in that when the amount of fuel is controlled in accordance with amount of heat being generated from the burner during operation of the burner, the speed of the blower motor is not controlled, and when the speed of the blower motor is controlled based on a variation in voltage, the amount of fuel being supplied to the burner is not controlled.

SUMMARY OF THE INVENTION

Therefore, it is an object of the present invention to provide an oil burner control apparatus for obtaining the optimum amount of heat from a burner.

It is another object of the present invention to provide a burner control apparatus for varying, in accordance with combustion conditions of the burner, the amount of fuel being supplied to the burner corresponding to the amount of heat being generated by the burner, so that the burner can efficiently generate the optimum quantity of heat.

A further object of the present invention is to provide a burner control system for supplying combustion air to the burner in accordance with the heat generating condition of the burner.

A further object of the present invention is to provide a burner control system for automatically selecting the output of the blower motor and the output of the electronic pump in agreement with the amount of heat being generated by the burner, so as to supply the optimum quantity of air and fuel to the burner based on the existing combustion conditions of the burner.

A further object of the present invention is to provide a method of controlling the blower motor and electronic pump, so as to supply the optimum quantity of air and fuel to the burner in accordance with the heat generating conditions of the burner.

The present invention, in accordance with the heat output desired, selects the heat generating condition of the burner, and controls the blower motor and electronic pump in accordance with the selected heat generating condition and varies the output of the blower motor and the electronic pump in consideration of the amount of heat being generated by the burner during its operation in order to enable the burner to generate the optimum quantity of heat.

In accordance with one aspect of the present invention, there is provided a burner control system for controlling loads, such as the blower motor and the electronic fuel pump, of a burner. The burner control sustem comprises a load drive voltage regulating means for varying drive voltages corresponding to said loads to vary amount of heat being generated from said burner in the actuated condition. A means is used for analog/-digital conversion of the output signals from said load drive voltage regulating means and for comparing the digital data with data stored therein to select proper data and outputting a plurality of load control signals in accordance with the compared results. A drive signal means for generating a plurality of drive signals for driving said loads in response to said plurality of load control signals from said load control signal output means is used. A driving means is employed for driving said loads in accordance with said plurality of drive signals from said drive signal generating means.

In accordance with another aspect of the present invention, there is provided a burner control method of controlling loads, such as a blower motor and an electronic pump, of a burner which comprises the steps of: selecting drive voltages corresponding to said loads; selecting data corresponding to said selected drive voltages to output a plurality of load control signals; and receiving said plurality of load control signals to lead to driving of said loads.

BRIEF DESCRIPTION OF THE DRAWINGS

The above and other objects, features and advantages of the present invention will be more clearly understood from the following detailed description taken in conjunction with the accompanying drawings, in which:

FIGS. 3*a* through 3*d* are data maps for control of the blower motor and the electronic pump, as previously stored in ROM in a microprocessor according to the principle of the present invention.

DETAILED DESCRIPTION OF PREFERRED EMBODIMENTS

Figure 1:
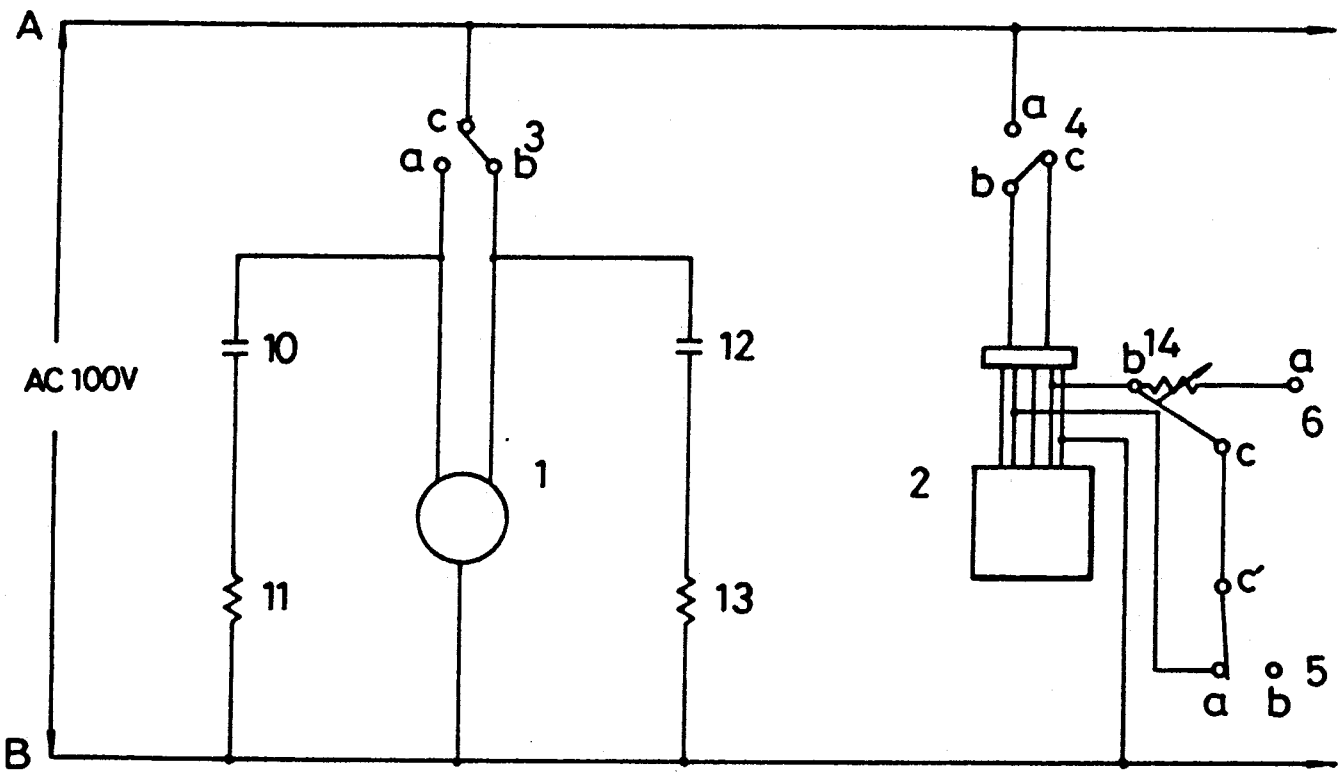
FIG. 1(Prior Art)
FIG. 1 illustrates a circuit diagram of the conventional burner control apparatus for controlling the blower motor and the electronic oil pump of a burner.
Figure 2:
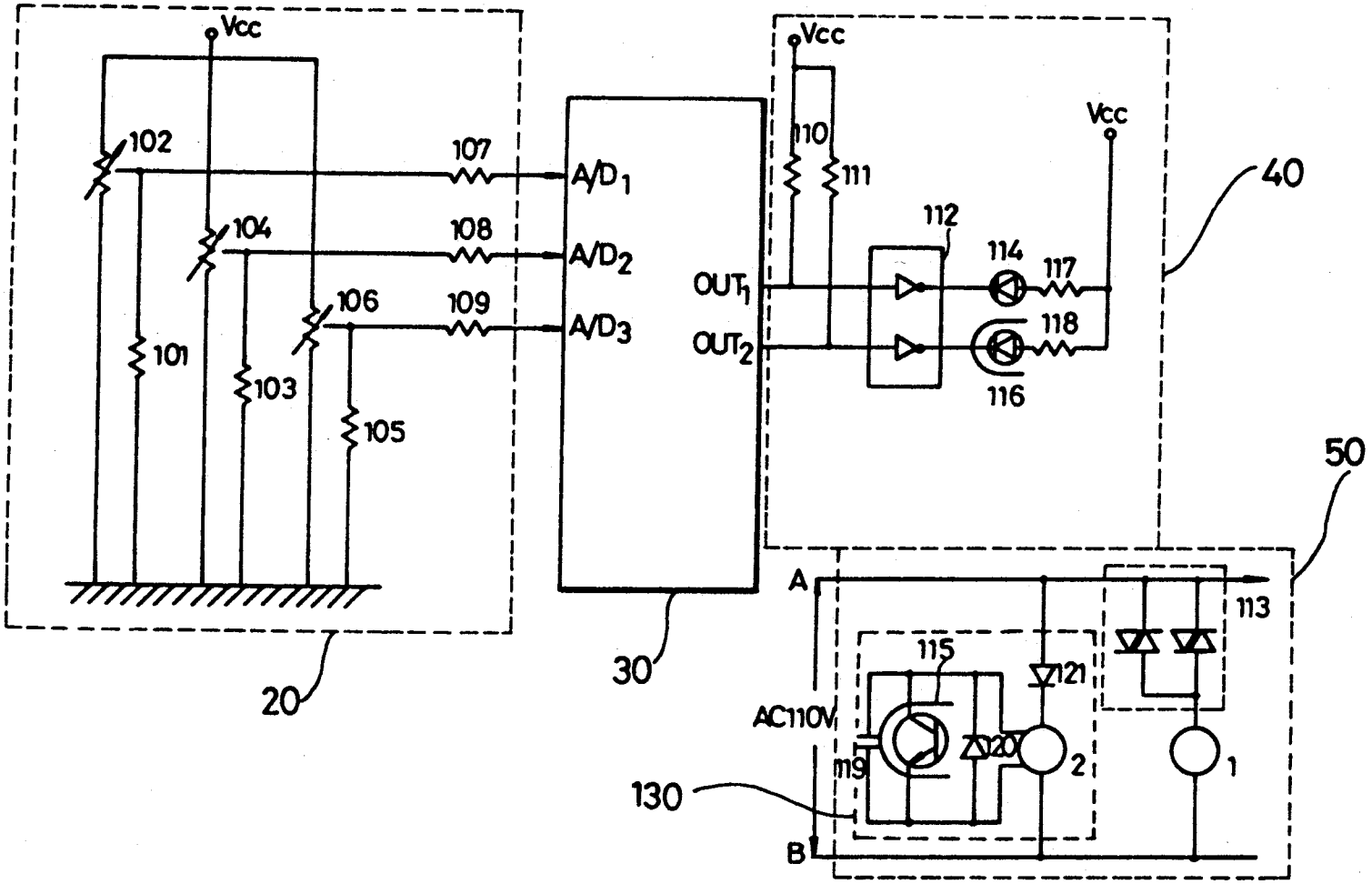
FIG. 2 illustrates a circuit diagram of the burner control apparatus for controlling the blower motor and the electronic oil pump of the burner according to the present invention.

FIG. 2 illustrates the burner control apparatus of the present invention which includes a drive voltage regulating circuit 20 as input means to a microprocessor 30.

The drive voltage regulating circuit 20 is provided with a variable resistor 102 for designating the range of variation in voltage when the speed of the blower motor 1 is at the maximum, a variable resistor 104 for designating the range of variation in voltage when the speed of the blower motor 1 is at the minimum, and a variable resistor 106 for designating the range of variation in voltage corresponding to the current amount of fuel being supplied by the electronic pump 2.

Connected in parallel to the variable resistor 102 is a resistor 101 for removing ripple voltage and connected in series to variable resistor 102 is a resistor 107 via which the variable resistor 102 is connected to an analog/digital conversion input terminal A/D1 of the microprocessor 30.

Connected to the variable resistor 104 is in parallel a resistor 103 for removing a ripple voltage and in series a resistor 108 via which the variable resistor 104 is connected to another analog/digital conversion input terminal A/D2 of the microprocessor 30.

Also, connected in parallel to the variable resistor 106 is a resistor 105 for removing a ripple voltage and connected in series to the variable resistor 106 is a resistor 109 which connects the variable resistor 106 to still another analog/digital conversion input terminal A/D3 of the microprocessor 30.

The burner control apparatus of the present invention also comprises a drive signal generating circuit 40 which is connected to output terminals OUT1 and OUT2 of the microprocessor 30, for generating actuating signals to the blower motor 1 and the electronic pump 2.

The drive signal generating circuit 40 is provided with a buffer 112 and a light emitting element 114 and a photocoupler light emitting element 116, both being triggered in response to output signals from the microprocessor 30.

Resistors 110 and 111 are pulled up to power source VC of a predetermined voltage 5 V between the buffer 112 and the output terminals OUT1 and OUT2 of the microprocessor 30.

Light emitting elements 114 and 116 are connected respectively via resistors 117 and 118 to power source VCC of a predetermined voltage 12 V.

As a result, the light emitting elements 114 and 116 are both illuminated, with being triggered in accordance with output frequencies from the output terminals OUT1 and OUT2 of the microprocessor 30.

Also, the burner control apparatus of the present invention comprises a driving circuit 50 which includes terminals A and B which are connected to a suitable power source of a predetermined voltage AC 100 V, the blower motor 1 and the electronic pump 2.

Connected in series between the blower motor 1 and the terminal A is a receiver 113 consisting of one or more triac light receiving elements connected in parallel.

The electronic pump 2 is connected to the terminal A via a rectifying diode 121 and the operation/driving hereof is controlled by a drive control section 130 in driving circuit 50.

The drive control section 130 is provided with a photocoupler light receiving element 115 to which are connected in parallel a reverse-flow preventing diode 120 and a condenser 119 being charged and discharged when triggered by the light emitting element 116.

On the other hand, the receiver 113 varies the number of rotations of the blower motor 1 by the triac light receiving elements being connected to a desired number of taps disposed at coils of the blower motor 1.

Similarly, the number of cycles of the electronic pump is determined based on an operating period which is generated by ON/OFF of relays (not shown) being operatively connected to the photocoupler light receiving element 115.

The microprocessor 30 contains a ROM therein, in which the desired data is stored.

FIG. 3*a* illustrates data representing a number of rotations related to the control of the blower motor in a high combustion heat generating step of the burner.

FIG. 3*b* illustrates analog frequency data related to the control of the blower motor in a low combustion heat generating step of the burner.

FIG. 3*d* illustrates data produced by comparing the input voltages depending on values of variable resistors 102 and 104 with reference to the intermediate number of rotations of the blower motor in a medium combustion heat generating step of the burner, the values of variable resistors 102 and 104 being determined in an initial heat generating step of the burner.

In connection with the control of the driving of the electronic pump, the data as shown in FIG. 3*d* is produced such that the number of cycles of the electronic pump is determined in accordance with an input voltage depending on a value of the variable resistor 106.

With the ROM storing therein the data maps as mentioned above, the microprocessor 30 can perceive the temperature of the heat being generated from the burner and the number of rotations of the blower motor, and control the blower motor and the electronic pump in the heat generating steps.

The operation of the burner control apparatus with the above-mentioned construction in accordance with the present invention is described below.

Upon powering the oil burner, the burner is operated in one of three conditions, high, medium and low heat output, in accordance with the heat output selected.

When the high output combustion condition is selected, the microprocessor 30 is controlled in the high output combustion condition by a self-program, with receiving at its input terminal A/D1 a voltage, the value of which is determined depending on the variable resistor 102 in the drive voltage regulating circuit 20.

Upon receiving that voltage, the microprocessor 30 analog/digital converts the received voltage and compares the digital value with data being classified into ten steps as shown in FIG. 3*a*, in order to select the proper data.

Hence, the microprocessor 30 outputs a signal corresponding to the number of rotations of the blower motor 1 at its output terminal OUT1 to the light emitting element 114 in the drive signal generating circuit 40 and therefore turns on the light receiving elements of the receiver 113, thereby enabling the rotation of the blower motor 1 to be controlled.

When the low output combustion condition is selected, the microprocessor 30 is controlled in the low combustion condition by the self-program, with receiving at its input terminal A/D2 a by the self-program, with receiving at its input terminal A/D2 a voltage, the value of which is determined within the range of voltage 0–5 V depending on the variable resistor 104 in the drive voltage regulating circuit 20, differently from that in the high combustion condition.

Upon receiving that voltage, the microprocessor 30 analog/digital converts the received voltage and compares the digital value with data being classified into ten steps as shown in FIG. 3*b*, in order to select the proper data.

Hence, the microprocessor 30 outputs a signal corresponding to the number of rotations of the blower motor 1 so as to control the blower motor 1 in the same manner as that in the high output combustion condition.

When the mid output combustion condition is selected, the microprocessor 30 is controlled in the mid output combustion condition by the self-program, with receiving at its input terminals A/D1 and A/D2 both voltages, the values of which are determined depending on the variable resistors 102 and 104 in the drive voltage regulating circuit 20, differently from those in the high and low combustion conditions.

Upon receiving those voltages, the microprocessor 30 outputs a signal corresponding to the number of rotations of the blower motor 1 by analog/digital converting the received voltages and comparing the digital values with data being classified into the total 100 steps by 10 steps as shown in FIG. 3*d*, in order to control the blower motor 1 in the same manner as that in the high and low output combustion conditions.

Namely, the microprocessor 30 outputs respective control signals based on each of combustion conditions at its output terminal OUT1 to the light emitting element 114 through the pull-up resistor 110 and the buffer 112, so as to trigger the light emitting element 114. The triggering of the light emitting element 114 results in the driving of the triac light receiving elements in the receiver 113 which is connected to the blower motor 1 disposed in the output stage, being operatively connected to the light emitting element 114. When the triac light receiving elements in the receiver 113 are driven and being connected to a desired number of taps disposed at coils of the blower motor 1, the blower motor 1 is driven, with the number of rotations being controlled.

On the other hand, the quantity of discharge from the electronic pump 2 is similarly selected in the same conditions as those of the blower motor 1, with reference to the number of rotations being selected in three conditions, high, medium and low output.

That is, the microprocessor 30 receives at its input terminal A/D3 a voltage, the value of which is determined depending on the variable resistor 106 in the drive voltage regulating circuit 20.

Upon receiving that voltage, the microprocessor 30 analog/digital converts the received voltage and compares the digital value with data being produced by classifying the input voltages, the values of which are determined depending on the variable resistors 102 and 104 in the drive voltage regulating circuit 20, into ten steps in accordance with the high, medium and low combustion conditions as shown in FIG. 3*d*.

Hence, the microprocessor 30 outputs a frequency signal corresponding to the received voltage at its output terminal OUT2 to the photocoupler light emitting element 116 in the drive signal generating circuit 40 via the pull-up resistor 111 and the buffer 112, so as to trigger the light emitting element 116.

The triggering of the light emitting element 116 results in the driving of the phototransistor 115 in the driving circuit 50 which is connected to the output stage, being operatively connected to the light emitting element 116. When the phototransistor 115 is driven, the light emitting element 116 being operatively connected thereto is turned on resulting in, the electronic pump 2 discharging the amount of oil properly in accordance with the combustion conditions.

Now, an example of the operation relating to the rotation of the blower motor and the fuel supply of the electronic pump in accordance with the combustion conditions as mentioned above will be given.

For instance, when the medium combustion condition is selected, the microprocessor 30 with reference to the blower motor 1 receives at its input terminals A/D1 and A/D2 both voltages, the values of which are determined depending on the variable resistors 102 and 104 in the drive voltage regulating circuit 20.

It is supposed that the voltage value depending on the variable resistor 102 is 2V and the voltage value depending on the variable resistor 104 is 2.5. Therefore, upon receiving those voltages, the microprocessor 30 outputs at its output terminal OUT1 1674 rpm, a value corresponding to the number of rotations of the blower motor 1 by analog/digital converting the received voltages and comparing the digital values with data being classified into the total 100 steps by 10 steps with reference to respective voltages through the input terminals A/D1 and A/D2 as shown in FIG. 3*d*.

This output value from the microprocessor 30 is inputted to the light emitting element 114 in the drive signal generating circuit 40 via the pull-up resistor 110 and the buffer 112, for driving of the light emitting element 114, and at the same time triggers the light receiving elements of the receiver 113 in the driving circuit 50, being operatively connected to the light emitting element 114.

At this time, the voltage across both terminals A and B is applied to the blower motor 1, so that the blower motor 1 can be driven, with the number of rotations being in accord with the heat generating condition.

On the other hand, with reference to the electronic pump 2 the microprocessor 30 receives at its input terminal A/D3 a voltage, the value of which is determined depending on the variable resistor 106 in the drive voltage regulating circuit 20 in accordance with the medium combustion condition. Upon receiving that voltage, the microprocessor 30 analog/digital converts the received voltage and compares the digital value with data being produced by classifying the input voltages, the values of which are determined depending on the variable resistors 102 and 104 in the drive voltage regulating circuit 20, into ten steps in accordance with the high, medium and low combustion conditions as shown in FIG. 3*c*.

Hence, supposing that the voltage value depending on the variable resistor 106 is 3.5 V, the microprocessor 30 outputs 15.94 Hz, a frequency signal corresponding to the received voltage, 3.5 V at its output terminal OUT2 (FIG. 3*c*).

This output value from the microprocessor 30 is inputted to the photocoupler light emitting element 116 in the drive signal generating circuit 40 via the pull-up resistor 111 and the buffer 112, for the turning on of the light emitting element 116, and at the same time triggers the phototransistor 115 in the driving circuit 50 which is connected to the output stage, being operatively connected to the light emitting element 116.

As the phototransistor 115 is driven, the voltage across both terminals A and B is applied to the electronic pump 2, thereby enabling the electronic pump 2 to supply the fuel corresponding to the medium combustion condition to the burner.

However, in the initial combustion, the fuel being discharged from the electronic pump 2 may be larger in quantity than the air being supplied from the blower motor 1. This results in imperfect combustion and therefore oil odor.

At this time, the operator varies the voltage value by varying the value of the variable resistor 106 in accordance with the combustion conditions of the burner, for introduction of perfect combustion and/or the microprocessor 30 receives a signal from a device 140 for detecting the amount of heat, for determining the corresponding electronic pump drive voltage in accordance with the current combustion condition.

For example, the microprocessor 30 outputs the frequency signal 15.29 Hz (FIG. 3*c*) corresponding to 2.5 V at its output terminal OUT2 to control the amount of fuel from the electronic pump 2, so that the number of rotations of blower motor 1 and the amount of fuel being supplied from the electronic pump 2 can be in accord with each other in accordance with the medium combustion condition, thereby preventing imperfect combustion.

As hereinbefore described, in accordance with the present invention, there are provided the burner control system and method which are capable of controlling the driving of the blower motor and the electronic pump, so that the number of rotations of blower motor and the amount of fuel being supplied from the electronic pump can be in accord with each other in accordance with the combustion conditions of the burner. Therefore, the thermal efficiency of the burner can be prevented from being degraded due to imperfect combustion which results from the discordance of the number of rotations of blower motor with the amount of fuel being supplied from the electronic pump.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A burner control system for controlling loads comprising a blower motor and an electronic pump of a burner, said burner control system comprising:

load drive voltage regulating means for varying load voltages of said loads corresponding to an amount of heat being generated from said burner by adjusting drive voltages of said loads;

means for providing a plurality of load control signals representing a number of blower rotations of the blower motor and representing a number of cycles of the electronic pump by converting and comparing said load voltages with stored data;

means, in response to said plurality of load control signals, for generating a photoelectric blower drive signal for driving said blower motor and for generating a photoelectric pump drive signal for driving said electronic pump; and driving means for driving said loads in accordance with said photoelectric blower drive signal and said photoelectric pump drive signal.

2. The burner control system as set forth in claim 1, wherein said load drive voltage regulating means comprises at least three variable voltage setting means, one said variable voltage setting means setting a maximum voltage value and another said variable voltage setting means setting a minimum voltage value.

3. The burner control system as set forth in claim 1, wherein said load drive voltage regulating means comprises at least three temperature-sensitive resistor means.

4. A burner control method of controlling loads comprising a blower motor and an electronic pump of a burner, said method comprising the steps of:

selecting drive voltages corresponding to said loads according to an amount of heat being generated by said burner;

providing a plurality of load control signals by selecting data corresponding to said selected drive voltages, said plurality of load control signals representing a number of blower rotations of the blower motor and a number of cycles of the electronic pump; and driving said loads photoelectrically in response to said plurality of load control signals.

5. The method of claim 4, further comprising the steps of:

generating a photoelectric blower drive signal for driving said blower motor; and generating a photoelectric pump drive signal for driving said electronic pump.

6. A burner control system comprising:

drive signal generating means for generating a photoelectric blower drive signal in response to a first voltage signal corresponding to a number of rotations of a blower motor in a given period and for generating an photoelectric pump drive signal in response to a second voltage signal corresponding to a frequency of an electronic pump during said given period, said drive signal generating means comprising a first light emitting element activated in response to said first voltage and a second light emitting element activated in response to said second voltage signal; and drive control means for driving said blower motor in response to said photoelectric blower drive signal and for driving said electronic pump in response to said photoelectric pump drive signal, said drive control means comprising a first light receiving element activated by said photoelectric blower drive signal and a second light receiving element activated by said photoelectric pump drive signal.

7. The burner control system of claim 6, wherein said drive control means further comprises said first light receiving element connected to a tap of the blower motor and said second light receiving element connected to the electronic pump.

8. The burner control system of claim 6, further comprising:

drive voltage regulating means for providing a blower regulating signal by adjusting a first variable resistor and for providing a pump regulating signal by adjusting a second variable resistor; and controller means for providing said first voltage signal by converting said blower regulating signal and comparing said converted blower regulating signal with a first stored value, and for providing said second volrage signal by converting said pump regulating signal and comparing said converted pump regulating signal with a second stored value.

9. The burner control system of claim 8, wherein said first stored value represents a predetermined number of rotations of the blower motor and said second stored value represents a predetermined frequency of the electronic pump.

10. The burner control system of claim 6, further comprising:

drive voltage regulating means for providing a blower regulating signal by adjusting one of a first variable resistor corresponding to a maximum said number of rotations of the blower motor, a second variable resistor corresponding to a minimum said number of rotations of the blower motor, and said first and second variable resistors in combination corresponding to a medium said number of rotations of the blower motor, and for providing a pump regulating signal by adjusting a third variable resistor corresponding to the frequency of the electronic pump; and controller means for providing said first voltage signal by converting said blower regulating signal and comparing said converted blower regulating signal with a first stored value, and for providing said second voltage signal by converting said pump regulating signal and comparing said converted pump regulating signal with a second stored value.

11. The burner control system of claim 10, wherein said first stored value represents a predetermined number of rotations of the blower motor and said second stored value represents a predetermined frequency of the electronic pump.

12. A method of a burner control system, comprising the steps of:

generating a photoelectric blower drive signal in response to a first voltage signal corresponding to a number of rotations of a blower motor in a given period;

generating a photoelectric pump drive signal in response to a second voltage signal corresponding to a frequency of an electronic pump during said given period;

driving said blower motor in response to said photoelectric blower drive signal; and driving said electronic pump in response to said photoelectric pump drive signal.

13. The method of claim 12, further comprising the steps of:

generating a blower regulating signal by adjusting a first variable resistor;

generating a pump regulating signal by adjusting a second variable resistor;

generating the photoelectric blower drive signal by converting said blower regulating signal and comparing said converted blower regulating signal with a first stored value; and generating the photoelectric pump signal by converting said pump regulating signal and comparing said converted pump regulating signal with a second stored value.

14. The method of claim 13, wherein said first stored value represents a predetermined said number of rotations of the blower motor and said second stored value represents a predetermined said frequency of the electronic pump.

15. The burner control system of claim 12, further comprising the steps of:

generating a blower regulating signal by adjusting one of a first variable resistor corresponding to a maximum said number of rotations of the blower motor, a second variable resistor corresponding to a minimum said number of rotations of the blower motor, and said first and second variable resistors in combination corresponding to a medium said number of rotations of the blower motor, generating a pump regulating signal by adjusting a third variable resistor corresponding to the frequency of the electronic pump;

generating said first voltage signal by converting said blower regulating signal and comparing said converted blower regulating signal with a first stored value; and generating said second voltage signal by converting said pump regulating signal and comparing said converted pump regulating signal with a second stored value.

16. The method of claim 15, wherein said first stored value represents a predetermined said number of rotations of the blower motor and said second stored value represents a predetermined said frequency of the electronic pump.

17. A driving circuit of a burner control system, comprising:

first receiving means for photoelectrically receiving a blower control signal for driving a blower motor corresponding to a number of rotations of the blower motor in a given period; and second receiving means for photoelectrically receiving an electronic pump control signal for driving an electronic pump corresponding to a frequency of the electronic pump during the given period.

18. The driving circuit of claim 17, wherein said first receiving means is connected to a tap of the blower motor.

19. The driving circuit of claim 17, wherein said second receiving means and the blower motor are serially connected to an alternating current power source.

20. The driving circuit of claim 17, wherein said second receiving means is connected in parallel with a reverse flow preventing device, a capacitor and the electronic pump, said electronic pump being connected in series with a rectifier to an alternating current power source.

21. The driving circuit of claim 17, further comprising:

transmitting means for photoelectrically transmitting the blower control signal in response to a first drive signal and photoelectrically transmitting the electronic pump control signal in response to a second drive signal.

22. The driving circuit of claim 21, wherein said transmitting means comprises:

a first light emitting device photocoupled to said first receiving means, said first light emitting device transmitting said blower control signal; and a second light emitting device photocoupled to said second receiving means, said second light emitting device transmitting said electronic pump control signal.

23. The driving circuit of claim 21, further comprising:

converting and comparing means for providing said first drive signal to said transmitting means by converting a blower regulating signal and comparing the converted blower regulating signal with a first stored value, and for providing said second drive signal to said transmitting means by converting an electronic pump regulating signal and comparing said converted electronic pump regulating signal with a second stored value.

24. The driving circuit of claim 23, wherein said first stored value represents a predetermined said number of rotations of the blower motor and said second stored value represents a predetermined said frequency of the electronic pump.

25. The driving circuit of claim 23, further comprising regulating means for providing the blower regulating signal by adjusting a first variable resistor and for providing the pump regulating signal by adjusting a second variable resistor.

26. The driving circuit of claim 23, further comprising regulating means for providing the blower regulating signal by adjusting one of a first variable resistor corresponding to a maximum said number of rotations of the blower motor, a second variable resistor corresponding to minimum said number of rotations of the blower motor, and said first and second variable resistors in combination corresponding to a medium said number of rotations of the blower motor, and for providing the pump regulating signal by adjusting a third variable resistor corresponding to the frequency of the electronic pump.

27. A method of a burner control system, comprising the steps of:

photoelectrically receiving a blower control signal for driving a blower motor corresponding to a number of rotations of said blower motor in a given period; and photoelectrically receiving an electronic pump control signal for driving an electronic pump corresponding to a frequency of said electronic pump during the given period.

28. The method of claim 27, further comprising the steps of:

photoelectrically transmitting the blower control signhal in response to a first drive signal and photoelectrically transmitting the electronic pump control signal in response to a second drive signal.

29. The method of claim 28, further comprising the steps of:

generating said first drive signal by converting a blower regulating signal and comparing the converted blower regulating signal with a first stored value, and generating said second drive signal to said transmitting means by converting an electronic pump regulating signal and comparing said converted electronic pump regulating signal with a second stored value.

30. The method of claim 29, wherein said first stored value represents a predetermined number of said rotations of the blower motor and said second stored value predetermined said frequency of the electronic pump.

31. The method of claim 29, further comprising the steps of:

generating the blower regulating signal by adjusting a first variable resistor; and generating the pump regulating signal by adjusting a second variable resistor.

32. The method of claim 29, further comprising the steps of:

generating the blower regulating signal by adjusting one of a first variable resistor corresponding to a maximum said number of rotations of the blower motor, a second variable resistor corresponding to a minimum said number of rotations of the blower motor, and said first and second variable resistors in combination corresponding to a medium said number of rotations of the blower motor; and generating the pump regulating signal by adjusting a third variable resistor corresponding to the frequency of the electronic pump.

* * * * *

UNITED STATES PATENT AND TRADEMARK OFFICE

CERTIFICATE OF CORRECTION

PATENT NO. : 5,261,811
DATED : 16 November 1993
INVENTOR(S) : Young Dawn Bae

It is certified that error appears in the above-indentified patent and that said Letters Patent is hereby corrected as shown below:

On the title page, item [75], inventor's name should read --Young Dawn Bae--

Column 14, line 2, change "signhal" to --signal--.

Signed and Sealed this

Twenty-third Day of August, 1994

*Attest:*

*Attesting Officer*

BRUCE LEHMAN

*Commissioner of Patents and Trademarks*